United States Patent [19]

Klee

[11] Patent Number: 5,054,292

[45] Date of Patent: Oct. 8, 1991

[54] CRYOGENIC FREEZER CONTROL

[75] Inventor: David J. Klee, Emmaus, Pa.

[73] Assignee: Air Products and Chemicals, Inc., Allentown, Pa.

[21] Appl. No.: 554,044

[22] Filed: Jul. 13, 1990

[51] Int. Cl.[5] ..... F25D 13/06

[52] U.S. Cl. ..... 62/63; 62/216; 62/374; 62/380

[58] Field of Search ..... 62/374, 375, 380, 63, 62/216

[56] References Cited

U.S. PATENT DOCUMENTS

| | | | |
|---|---|---|---|
| 3,403,527 | 10/1968 | Berreth et al. | 62/266 |
| 3,427,820 | 2/1969 | Hart | 62/374 |
| 3,613,386 | 10/1971 | Klee | 62/64 |
| 3,813,895 | 6/1974 | Klee et al. | 62/266 |
| 3,892,104 | 7/1975 | Klee et al. | 62/186 |
| 4,229,947 | 10/1980 | Klee | 62/374 |
| 4,237,695 | 12/1980 | Oberpriller et al. | 62/375 |
| 4,475,351 | 10/1984 | Klee | 62/63 |
| 4,589,264 | 5/1986 | Astrom | 62/374 |
| 4,800,728 | 1/1989 | Klee | 62/63 |

*Primary Examiner*—Ronald C. Capossela

*Attorney, Agent, or Firm*—James C. Simmons; William F. Marsh

[57] ABSTRACT

Method and apparatus for controlling the cooldown and steady-state operation of a tunnel type cryogenic freezer by providing auxiliary cryogen to one or more gas recirculating zones of the freezer and controlling the supply of the auxiliary cryogen by sensing the temperature of the gas recirculating zone and comparing the temperature to a pre-set level.

10 Claims, 2 Drawing Sheets

CRYOGENIC FREEZER CONTROL

FIELD OF THE INVENTION

The present invention pertains to enhancing the cooldown and the steady state operation of a tunnel-type cryogenic food freezer.

BACKGROUND OF THE INVENTION

In-line tunnel-type cryogenic food freezers, such as those sold under the trademark CRYO-QUICK by Air Products and Chemicals, Inc., utilize liquid nitrogen (LIN) as an expendable refrigerant. Examples of such freezers are shown and described in U.S. Pat. Nos. 3,403,527, 3,813,895, 3,892,104, 4,229,947, 4,475,351 and 4,800,728. Freezers of the type shown in the aforementioned patents can achieve high thermal efficiency because they are designed as counterflow heat exchangers. Liquid cryogen (e.g., liquid nitrogen or LIN) is sprayed onto the product being refrigerated adjacent to the discharge end of the freezer or tunnel. The cold nitrogen gas at −320° F. (−196° C.) evolved in the liquid nitrogen spray zone, moves through multiple zones of gas recirculation as it flows to the entrance end of the freezer. Since the maximum available refrigeration has been utlized at that point, the warm nitrogen gas can be vented to the outside atmosphere by an exhaust blower.

Current tunnel-type food freezers sold under the CRYO-QUICK trademark include a liquid nitrogen control system such as described and claimed in U.S. Pat. No. 3,613,386. The amount of liquid nitrogen introduced into the freezer utilizing the '386 control system is controlled by the liquid nitrogen spray header pressure and the recirculating gas temperature. As a result, the control system will maintain the total heat transfer capability of the freezer at a constant rate during production.

The present control system has a disadvantage during the initial cooldown of the freezer. Since the recirculating gases at ambient temperature, e.g., 70° F. (21° C.), the cryogen flow control valve will open fully. Under these circumstances, the liquid nitrogen may not vaporize completely and may leak from the freezer.

SUMMARY OF THE INVENTION

The present invention provides an improved cryogenic freezer control system for aiding in the cooldown of the freezer and in maintenance of a steady state operation by providing injection of auxiliary liquid cryogen (e.g., liquid nitrogen) into at least one and preferably one-half all of the gas recirculating zones of the freezer beginning with the zone adjacent to the liquid oxygen spray levels. Injection of the liquid nitrogen into the gas recirculating zones is controlled by sensing the temperature of the gas recirculating in the zone into which auxiliary liquid cryogen is injected and which is further from the spray header, comparing this temperature to a reference value, which is based upon a preset temperature, and increasing or decreasing the liquid cryogen introduced into the gas recirculating zones.

DESCRIPTION OF THE PREFERRED EMBODIMENT

Figure 1:
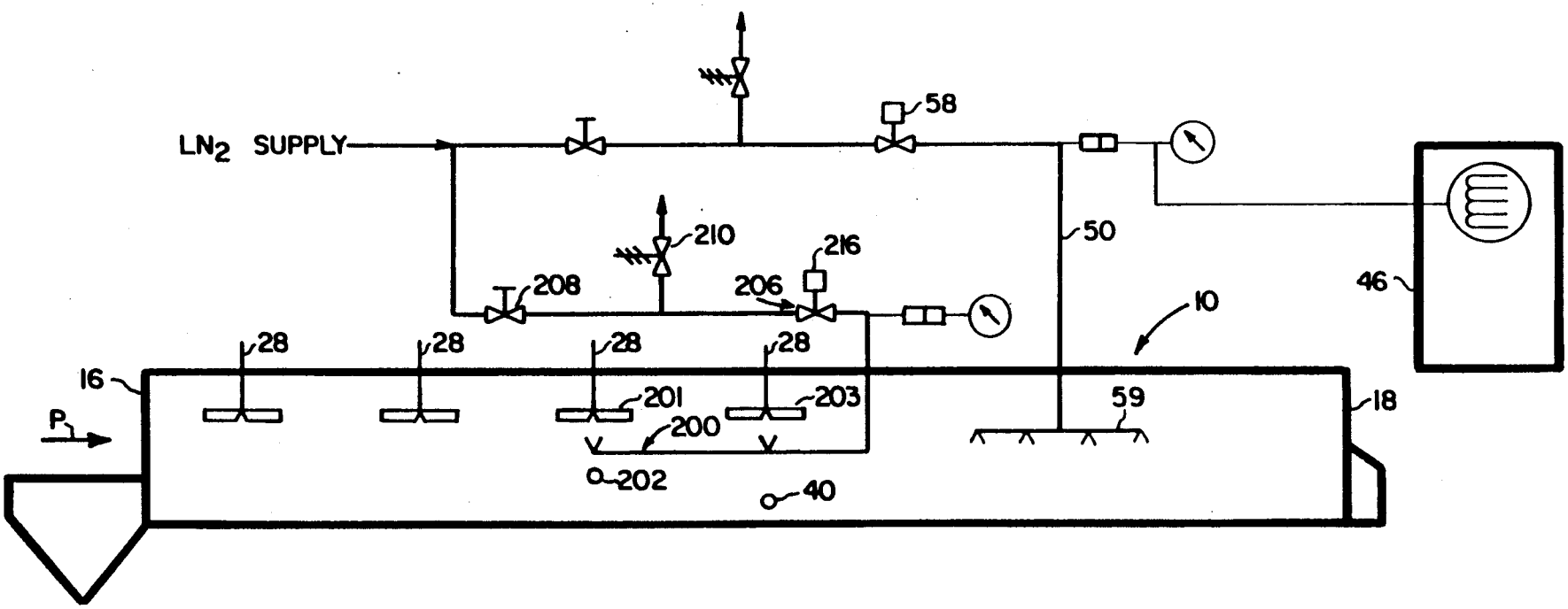
FIG. 1 is a schematic diagram of the liquid nitrogen supply system for a tunnel-type freezer including the auxiliary supply according to the present invention.

As pointed out above, the liquid cryogen control system disclosed in U.S. Pat. No. 3,613,386 has disadvantages during the initial cooldown of the freezer which may result in liquid cryogen leaking from the freezer. This problem becomes more serious if the liquid cryogen storage tank pressure is much higher than necessary. For example, when liquid nitrogen is employed as the liquid cryogen, normal liquid nitrogen spray header pressure is 7 psig (48 kPa) with a liquid nitrogen storage tank pressure of 10 psig (69 kPa). However, if the liquid nitrogen storage tank pressure increases to 17 psig (117 kPa), the liquid nitrogen spray header pressure will increase significantly causing the freezer to be flooded with liquid nitrogen. The resulting liquid nitrogen may leak from the freeze causing damage to the floor and result in a safety problem from slippery floors or creation of an oxygen-deficient atmosphere.

Another problem with the present control system is the temperature decrease in the gas recirculation zones when the freezer is empty, such as during production interruption. For food products entering at 70° F. (21° C.), the temperature of the entrance zone or Zone 1 of the freezer will be about −10° F. (−23° C.). The zones of the freezer are illustrated in U.S. Pat. No. 3,613,386, the specification drawing and claims thereof being incorporated herein by reference. When the freezer becomes empty, the entrance temperature will gradually lower or become colder and reach a level of −60° F. (−51° C.) without causing any operating difficulties. However, refrigerated foods, such as a fresh hamburger patty, the food product will enter the freezer at about 30° F. (−1° C.). As a result, the entrance for zone 1 temperature will be about −50° F. (−46° C.) in normal operation. Then, during a production interruption, the entrance temperature will gradually decrease to about −100° F. (−73° C.). Under these operating conditions, the conveyor belt movement of the freezer will become erratic, exhibiting a stick-slip motion. When production resumes, the operator will have difficulty maintaining the correct patty spacing on the conveyor belt, a problem that will reduce the thermal efficiency of the freezer. Prior to the present invention, one solution to the cooldown problem is to cool the freezer to operating temperature using manual control methods. During cooldown, the freezer operator turns off the automatic liquid nitrogen control system. Then the operator adjusts the croygenic flow control valve for the main liquid nitrogen spray header to achieve a pressure of between 3 and 6 psig (21 to 42 kPa). When the indicator of the liquid nitrogen controller reaches the normal setpoint, the freezer operator then turns the automatic control system on to continue the freezer cooldown.

In order to overcome erratic conveyor belt movement, the freezer operator must adjust the liquid nitrogen controller setpoint to a lower value when production is interrupted. When production is about to resume, the operator must readjust the liquid nitrogen controller to the normal operating setpoint. Thus, it can be seen that these operating techniques require careful operator retention for optimum performance of the freezer. In many instances, the freezer operator may be concerned with other duties and may not be able to take corrective action in a timely manner, leading to the problems noted above.

Referring to FIG. 1, numeral 10 indicates the outline of a tunnel-type food freezer such as shown and described in the U.S. patents enumerated above. The numbers to the extent that they are identical refer to like equipment in the specification and drawing of U.S. Pat. No. 3,613,386. The freezer 10 has an entry end 16 and a product discharge or exit end 18. A continuous product belt (not shown) driven by a motor (not shown) is disposed inside the freezer 10 to move the product along a generally horizontal path from the entry end 16 to the exit end 18. A plurality of fans 28 are used to create recirculating zones within the freezer. The recirculating zones are created when a liquid cryogen (e.g., nitrogen) is introduced onto the product moving through the freezer by means of the spray header 59. The fans 28 are arranged so that the cryogen as it vaporizes is gradually moved in countercurrent flow to the product direction shown by the arrow P to provide precooling of the product prior to coming under the spray header 59. The thermocouple 40 and spray header 59, conduit 50 and valve 58 as well as power supply 46 are identical or equivalent to that shown in the '386 patent and are used to control the heat transfer of the freezer 10. According to the present invention, at least one, and preferably a plurality of auxiliary liquid cryogen spray devices 200, are introduced into the tunnel 10 to spray liquid nitrogen into the recirculating zones defined by individual fans as schematically represented. While it is preferable to introduce cryogen into one-half of the recirculating zones, at least one recirculating zone should have the auxiliary liquid nitrogen system according to the present invention. The liquid nitrogen supply system 200 is connected through a motor control valve 206, manual control valve 208 to a liquid nitrogen supply which will also supply the spray header 59. A pressure relief valve 210 is included in the auxiliary system for safety reasons.

Figure 2:
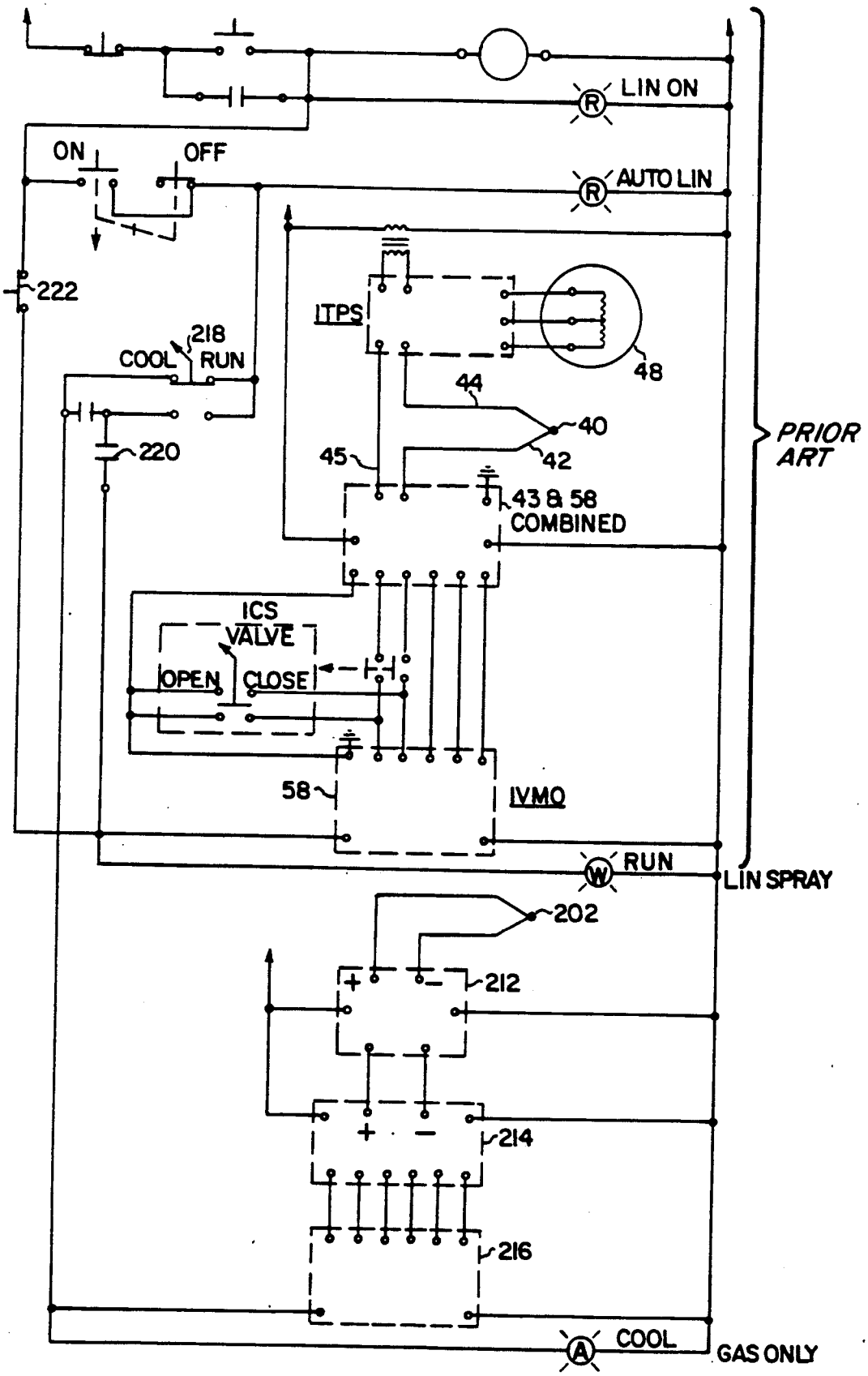
FIG. 2 is a schematic diagram of the basic control system according to the present invention.

Referring to FIG. 2, the portion of the schematic labeled "Prior Art" is the cryogenic control system described in U.S. Pat. No. 3,613,386. The basic components are the thermocouple 40, the millivolt controller 43 and 58 combined, the DC millivolt power supply identified as 1 TPS, the pressure transducer 48 and the valve motor operator 58. The present model of the millivolt controller used in the device of the '386 patent does not require the use of a current to position converter. However, this portion of the control system operates in an identical manner to the system described in the '386 patent.

The improvement to the cryogenic freezer control labeled "Prior Art" in FIG. 2 is a second control system that controls injection of the liquid nitrogen into several of the recirculating fans 28 based upon the temperature of the gas in the recirculating zone. The method of introducing liquid nitrogen into the freezer is shown by the piping schematic of FIG. 1 as described above. As in the conventional freezer, the main liquid nitrogen spray header is located adjacent to the discharge ends 18 of the freezer 10. The second control system according to the invention delivers liquid nitrogen to multiple nozzles 201, 203 in the delivery device 200 that inject liquid nitrogen into the gas recirculating stream. Thermocouple 202, is used to sense the temperature of the gas recirculating zone used for control purposes. A temperature controller 212 such as a model 3024-585 sold by Love Controls Corporation provides a controlled direct current milliamp output to a current-to-position converter 214. The current-to-position converter 214 regulates to position of the valve motor operator 216 which is connected to the valve 206. The valve motor operator 216 maintains the recirculating gas temperature at the desired level.

A selector switch 218 is used by the freezer operator to establish the proper operating mode. When the selector switch 218 is turned to the cool setting, the second control system will maintain the freezer at the proper operating temperature. When the freezer is ready for production, the freezer operator turns the selector switch 218 to the run position. Then the control system labeled "Prior Art" regulates the flow of liquid nitrogen into the freezer to maintain the proper frozen food temperature.

A control relay 200 is used to start and stop the conveyor belt drive of the freezer. When the conveyor belt drive is stopped by the freezer operator, the rely contacts automatically change the control system from the run mode to the cool mode. A push button contact 222 allows the freezer operator to turn the automatic liquid nitrogen control off and manually operate the valve motor operator 58 that delivers liquid nitrogen to the direct or primary contact liquid nitrogen spray header.

In order to utilize the present invention when the freezer operator is ready to cool down the freezer, he turns on the supply of liquid nitrogen and selects the cool mode of operation by positioning switch 218 at its proper location. Temperature controller 212 is adjusted for a setpoint of −150° F. (−101° C.), which is the normal operating temperature of the recirculating gas. The control system of the present invention opens the valve motor operator 216 to admit liquid nitrogen to the auxiliary device 200 through control valve 206. As the recirculating gas temperature decreases, the amount of liquid nitrogen is reduced to maintain preset temperature. Since the preset temperature is much warmer than the temperature of liquid nitrogen, e.g. −320° F (−196° C.), all the liquid nitrogen is vaporized and a liquid nitrogen leak cannot occur.

When production is interrupted during the lunch period or a machine break down, the freezer operator turns the selector switch 218 from Run to Cool. The control system then closes the valve motor operator 58 to prevent liquid nitrogen from being sent to the direct liquid nitrogen spray header 59, and energizes the temperature control valve motor operator 216. The temperature controller then maintains the freezer at the normal operating temperature until production can be resumed. Since the freezer temperature does not shift to substantially colder, the problem with erratic conveyor belt drive is eliminated.

If a breakdown occurs in the packaging equipment for the frozen food, the freezer operator can merely stop the conveyor belt drive until the breakdown is repaired and production can be resumed. The control system will automatically change to the cool mode to maintain the normal operating temperature without liquid nitrogen leaks or erratic conveyor belt movement. When production can be restarted, the freezer operator then starts the conveyor belt drive. The control system will automatically change back to the run mode for the normal liquid nitrogen freezing operation. The major advantage of the improved control system according to the present invention is that it does not attempt to regulate the flow of liquid nitrogen entering the direct liquid nitrogen spray header to avoid liquid nitrogen leaks from the freezer. The conventional cyroquick freezer uses a tray position under the conveyor belt to collect any excess liquid nitrogen that is not vaporized by contact with the food. Gutters extending from this tray are used to convey the excess liquid nitrogen to the relatively warm circulation zone of the freezer where it can be vaporized. However, if the volume of excess liquid nitrogen exceeds the capacity of the gutters, it will spill over and leak out of the freezer.

Liquid nitrogen injected into the recirculating fans is mixed with the relatively warm gas and is vaporized without contact with the food product. Since the temperature controller maintains this mixture at a temperature much warmer than the liquefaction temperature of liquid nitrogen, liquid nitrogen cannot accumulate within the freezer. Thus, liquid nitrogen cannot leak from the freezer.

In view of the fact that the amount of liquid nitrogen introduced into the freezer during cool down and production interruptions is controlled by temperature only, excessive liquid nitrogen storage tank pressure cannot cause a liquid nitrogen leak by flooding the freezer with liquid nitrogen.

Having thus described my invention what is desired to be secured by Letters Patent of the United States is set forth in the appended Claims.

1. In a tunnel-type cryogenic freezer having a primary refrigerant spray zone and a plurality of gas circulation zones a system to aid in cooldown and maintenance of the freezer at operating temperature, comprising in combination:

means to inject supplementary liquid cryogen into at least one gas recirculation zone in said freezer;

means to sensee the temperature in the gas recirculation zone of the freezer into which the supplementary liquid cryogen is injected, said temperature sensing means generating an electrical signal;

means for comparing said electrical signal to a reference signal established as a desired temperature in said gas recirculation zone; and means for increasing or decreasing the supply of cryogen to the gas recirculation zone, said means responsive to and controlled by a difference in signal between the reference signal and the temperature signal.

2. A freezer according to claim 1 wherein there is a system associated with approximately one-half of the gas recirculation zones of the freezer.

3. A system according to claim 1 wherein the temperature sensing means is a thermocouple.

4. A system according to claim 1 wherein said means for supplying liquid cryogen is a spray nozzle juxtaposed to a recirculating fan in the recirculating zone of said freezer.

5. A system according to claim 1 wherein said means for increasing or decreasing the supply of cryogen in an electrically controlled valve disposed in a conduit between a source of liquid cryogen and said means to inject liquid cryogen into said gas recirculating zone.

6. A freezer according to claim 1 wherein there is included a system for controlling the heat transfer capability of the freezer by sensing temperature in the coldest gas recirculating zone and pressure of cryogen in a main cryogen spray device and utilizing this data to control the supply of cryogen to the main cryogen spray device.

7. A system according to claim 3 wherein said thermocouple is of the copper-constantin type.

8. A method of enhancing to cooldown and steady state operation of a tunnel-type cryogenic freezer having a primary refrigerant spray zone and a plurality of gas circulation zones comprising the steps of:

injecting auxiliary liquid cryogen into at least one gas recirculation zone of said freezer;

continuously measuring the temperature of said gas recirculation zone;

comparing the temperature of said gas recirculation zone to a predetermined temperature level; and changing the flow of liquid cryogen in order to maintain the predetermined level of temperature in said gas recirculation zone.

9. A method according the claim 3 applied to approximately one-half of the gas recirculation zones of said freezer.

10. A temperature control system for a cryogenic food freezer of the tunnel-type having a primary refrigerant spray zone and a plurality of gas recirculation zones comprising in combination:

means for supplying supplementary liquid cryogen for at least one gas recirculating zone of said freezer;

means for sensing temperature in said gas recirculating zone, said means generally an electrical signal;

means to establish an electrical signal indicative of a desired temperature in said gas recirculating zone;

means to compare said electrical signals and provide a signal to control means to increase or decrease the supply of auxiliary liquid cryogen to the gas recirculation zone.

* * * * *